US005105924A

United States Patent [19]

Carlson

[11] Patent Number: 5,105,924

[45] Date of Patent: Apr. 21, 1992

[54] NO FEEDBACK STEERING SYSTEM

[75] Inventor: John Carlson, Wayne, Pa.

[73] Assignee: Teleflex Incorporated, Limerick, Pa.

[21] Appl. No.: 543,553

[22] Filed: Jun. 26, 1990

[51] Int. Cl.[5] ..... F16D 71/00

[52] U.S. Cl. ..... 192/8 R; 114/144 R

[58] Field of Search ..... 114/144 R; 192/8 R

[56] References Cited

U.S. PATENT DOCUMENTS

| | | | |
|---|---|---|---|
| 275,388 | 4/1883 | Huyck | 192/8 R |
| 385,123 | 6/1988 | Lake | 192/8 R |
| 1,990,153 | 2/1935 | Woolson | 192/8 R |
| 2,209,122 | 7/1940 | Houplain | 192/8 R |
| 2,258,307 | 10/1941 | Vickers | 192/8 R |
| 2,633,213 | 3/1953 | Houplain | 192/8 R |
| 2,819,777 | 1/1958 | Kosch | 114/144 R |
| 2,819,778 | 1/1958 | Kosch | 114/144 R |
| 3,039,420 | 6/1962 | Bevis et al. | 192/8 R |
| 3,208,300 | 9/1965 | Morse | 114/144 R |
| 3,796,292 | 3/1974 | Harrison | 114/144 R X |
| 4,263,994 | 4/1981 | Hayes | 192/8 R |
| 4,449,420 | 5/1984 | Baba | 114/144 R X |

*Primary Examiner*—Leslie A. Braun

*Assistant Examiner*—Khoi Q. Ta

*Attorney, Agent, or Firm*—Reising, Ethington, Barnard, Perry & Milton

[57] ABSTRACT

An assembly (10) for connection between a steering wheel (12) and a steerable member (14) includes a clutch mechanism (28) operatively connected to the steering wheel (12) and a drive mechanism (30) connected between the clutch mechanism (28) and a push pull cable (22). The push pull cable (22) is in turn connected to the steerable member (14). The clutch mechanism (28) prevents torsional forces from the steerable member (14) to be transmitted to the steering wheel (12). The clutch mechanism (28) includes a driving dog (38) connected to the steering wheel shaft (18) and a pinion member (40) connected to the drive mechanism (30). The driving dog (38) includes three radially extending legs (44, 45, 46) and the pinion member (40) includes arcuate arms (64, 65, 66) extending therebetween. Rollers (84–89) are biased by springs (96–98) to be wedged between the arms (64, 65, 66) and housing (32), and are released only upon rotation of the legs (44, 45, 46).

14 Claims, 3 Drawing Sheets

NO FEEDBACK STEERING SYSTEM

TECHNICAL FIELD

The invention relates to a clutch mechanism located in steering linkage, and more particularly, a mechanism between a steering wheel and a steerable member to prevent torsional forces on the steerable member from being transmitted to the steering wheel.

BACKGROUND OF THE INVENTION

In present steering systems, particularly with respect to boats utilizing a steering wheel and rudder, the propeller torque and rudder forces transmitted back to the steering wheel require a constant "hands on" to overcome this torque. Therefore, a clutch mechanism is incorporated directly between the steering wheel and the rudder to prevent these forces from acting on the steering wheel.

One such assembly is disclosed in U.S. Pat. No. 385,123 issued Jun. 26, 1888 in the name of Lake. The patent discloses a clutch for use on steering mechanisms where it is desired to retain a shaft and its attached mechanism, such as a wheel or a rudder, in any desired position and to be able to quickly change from one position to another. The patent utilizes a mechanism having a generally circular housing having clutch levers fitted to the bottom of the housing. Stops are positioned near the edge of the bottom to limit the movement of the clutch levers. Flat metal springs are held in position by pins wherein their ends impinge against the sides of the levers and press the same toward each other. When pressed toward each other by the action of the springs, their outer ends extend beyond the edge of the bottom plate and forms wedges effectively preventing the bottom plate from being rotated. Keys or block fittings between the inner sides of the clutch levers serve to separate the same upon rotation of the steering wheel or turning member.

Another type of clutch mechanism used in transmission is disclosed in U.S. Pat. No. 2,258,307 issued Oct. 7, 1941 of Vickers. Two arcuate driving dogs are rotatably disposed within a circular housing. A roller retainer plate is disposed between the driving dog in spaced relationship therefrom. The roller retainer plate is generally rectangular in shape with a camming surface provided in each of the four corners. Between each camming surface and driving dog is a cylindrical roller. A compression spring extends between two adjacent camming surfaces to press outwardly against the roller thereby wedging the rollers between the roller retaining plate and the housing.

The prior art does not disclose a clutch mechanism in a steering linkage which controls a remote steering member.

SUMMARY OF THE INVENTION AND ADVANTAGES

The invention includes an assembly for preventing feedback from a steerable member to a steering wheel. The assembly includes push-pull cable having a first end adapted to be connected to the steerable member and having a second end. Helm means is adapted to be connected to the steering wheel for controlling the push-pull cable and for transmitting torsional forces from steering wheel through said push-pull cable to the steerable member in a transmitting condition while preventing torsional forces from the steerable member from being transmitted to the steering wheel in a blocking condition.

The invention also includes the housing means having a circular interior surface. A driving dog means is rotatable within the housing and adapted to be secured to a steering wheel and includes at least two radially extending arms extending to the housing means. A pinion means is adapted to be secured to a driven member and extends between the arms. The pinion means is rotatable within the housing means. Roller means are rotatable within the housing and are operatively connected between the pinion means and the housing means and the driving dog means. A biasing means is connected to the pinion means and extends against the roller means for wedging the roller between the pinion means and the housing means in response to torsional forces by the driven member to prevent resultant rotation of the pinion means and the driving dog means, and for releasing the roller means upon rotation of the steering wheel and engagement of the arm against the roller means to unwedge the roller means rotating the driven member in response to rotation by the steering wheel.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
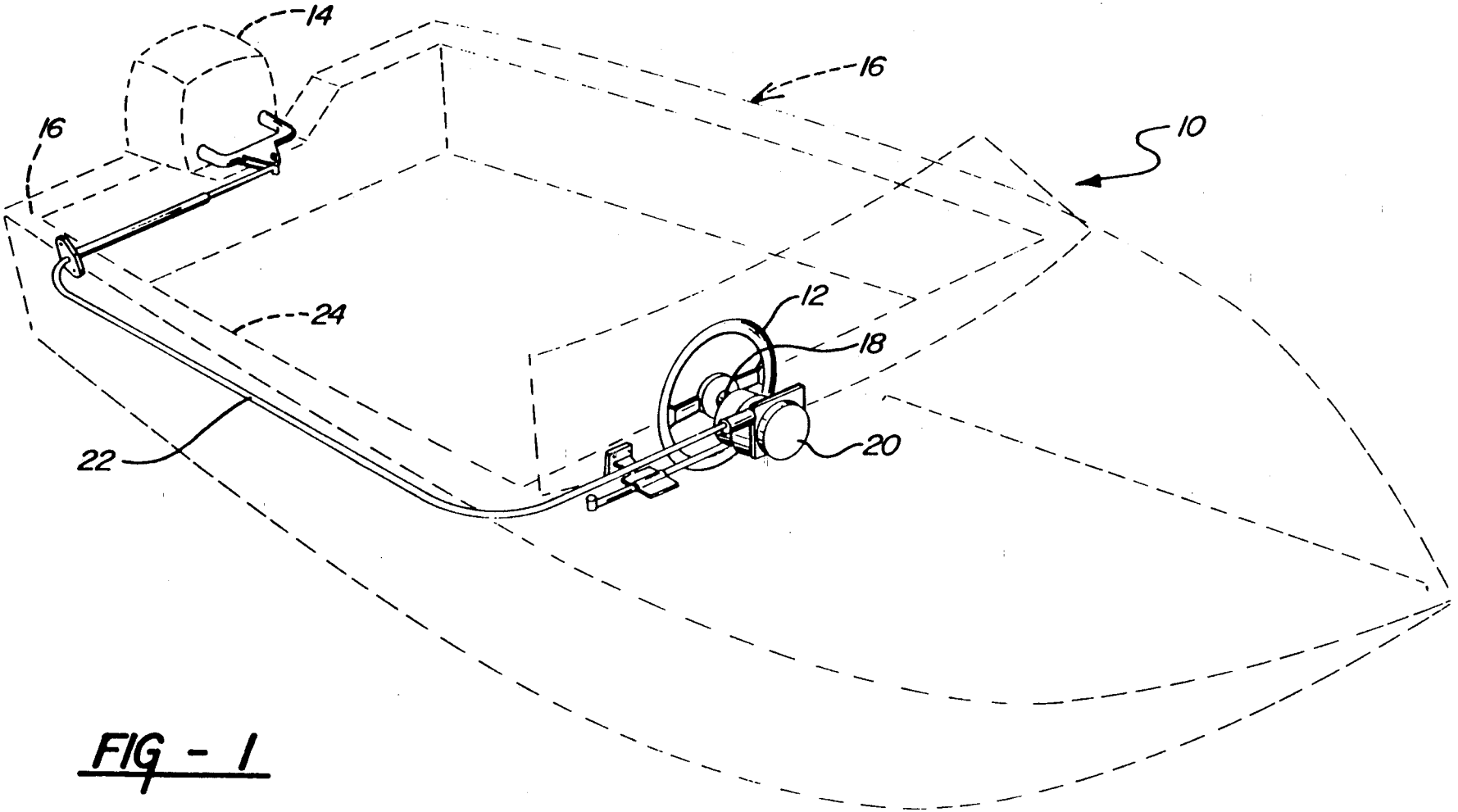
FIG. 1 is a perspective view of a marine vehicle utilizing the subject invention.
Figure 2:
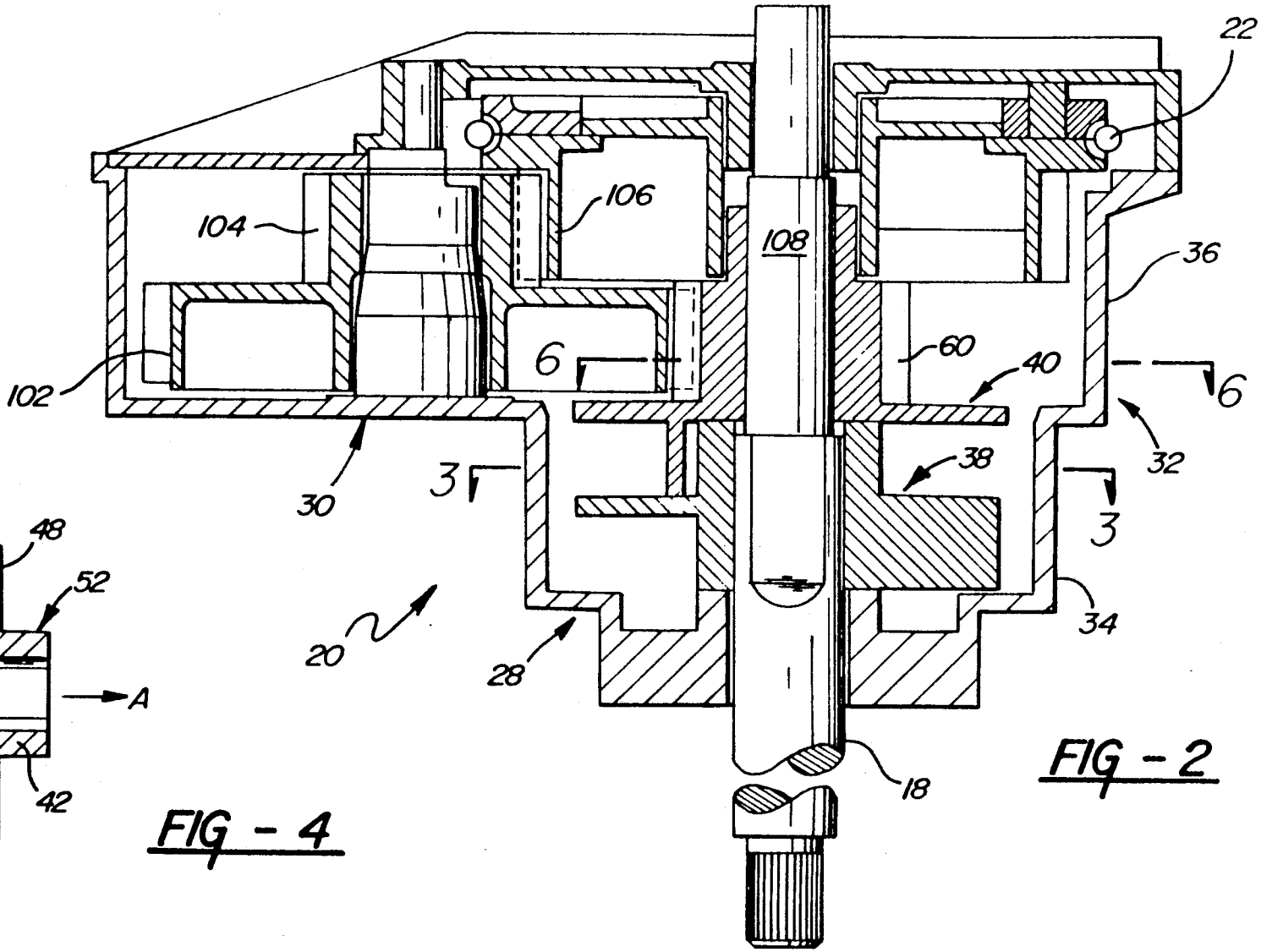
FIG. 2 is a cross-sectional view of the subject invention.

A steering assembly for connecting a steering wheel 12 to a driven member 14 is generally indicated at 10 in FIG. 1. In the preferred embodiment, the assembly 10 is utilized in a marine vehicle 16, such as a boat, to operatively connect the steering wheel 12 to the steerable or driven member 14, generally a rudder. The subject invention may be used in a variety of applications, and is not limited to boat steering systems.

The steering assembly 10 includes a steering shaft 18 extending from the rotatable steering wheel therefrom to a helm assembly 20. The helm assembly 20 is operatively responsive to rotation of the steering shaft 18 to drive a flexible push-pull cable 22. The push-pull cable 22 converts the rotational movement into linear movement. The push-pull cable 22 extends to the rear of the boat 16 to the steerable member 14. The cable 22 extends within the housing of the boat 16 and through the splashwall 24 to the steerable member 14. The cable 22 may be mounted and slideably secured to the splashwall 24 or slideably connected to the transom 26, and in turn connected to the steerable member 14. The steerable member 14 is pivoted in response to the pushing or pulling by the cable 22, which is in turn responsive to rotation by the steering wheel 12.

The helm assembly 20 includes clutch means 28 operatively connected to the steering wheel shaft 18 for preventing feedback of torsional forces from the steerable member 14 to the steering wheel 12. The helm assembly 20 also includes drive means 30 operatively connected between the clutch means 28 and the push-pull cable 22 for driving the cable 22 in response to rotation by the steering wheel 12.

The helm assembly 20 includes a circular helm housing 32 having a first diameter portion 34 offset to a second diameter portion 36. The first diameter portion 34 encompasses the clutch means 28 and the second diameter portion 36 encompasses the drive means 30.

Figure 4:
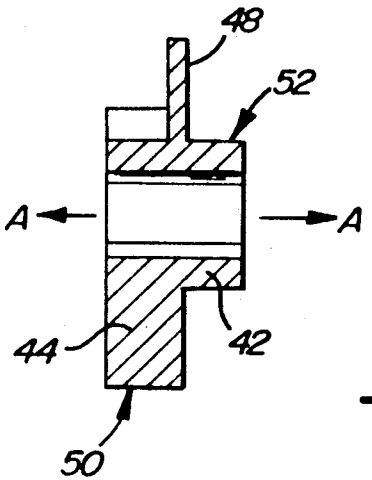
FIG. 4 is a cross-sectional view of the driving dog taken along lines 4—4 of FIG. 3.
Figure 6:
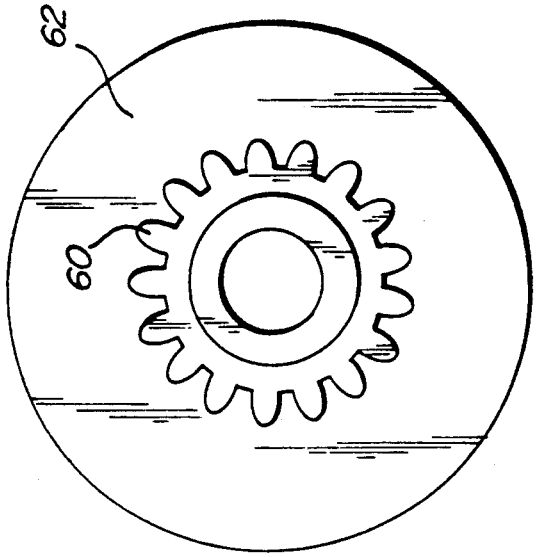
FIG. 6 is a view of the pinion means taken along lines 6—6 of FIG. 2.
Figure 5:
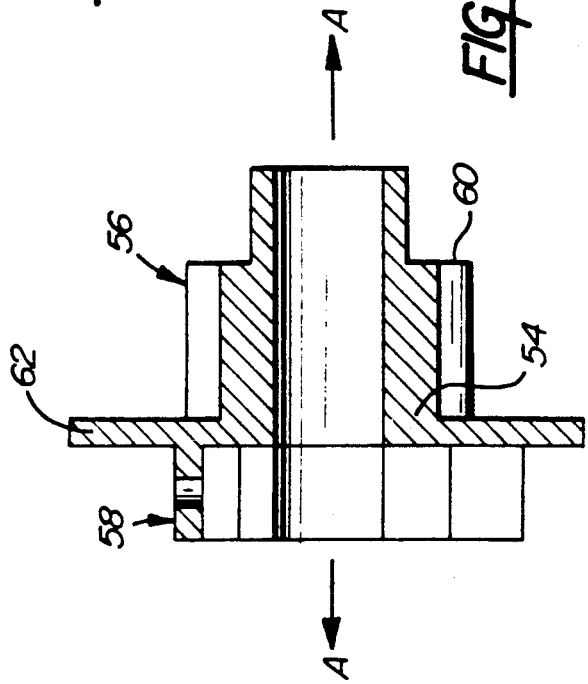
FIG. 5 is a cross-sectional view of the pinion means taken along lines 4—4 of FIG. 3.

The clutch means 28 includes a driving dog 38 operatively connected to the steering wheel shaft 18, and a pinion means 40 operatively connected to the drive means 30. The driving dog 38 includes a hollow cylindrical portion 42 for fixedly receiving the steering wheel shaft 18. Three legs 44, 45, 46 are integral with and radially extend from the cylindrical portion 42 toward the helm housing 32. The legs 44, 45, 46 extend to but do not contact the helm housing 32 to ensure free rotation of the driving dog 38 therewithin. As best illustrated in FIG. 4, the legs 44, 45, 46 extend longitudinally along the cylindrical portion 42 for one half thereof. The cylindrical portion 42 includes driving plates 48 extending radially outwardly between the legs 44, 45, 46. The driving plates 48 extend between each of the legs 44, 45, 46 at a point halfway along the longitudinal axis A of the cylindrical portion 42. The cylindrical portion 42 is comprised of a first half 50 containing the legs 44, 45, 46 and a second half 52 which is connected to the steering wheel shaft 18. The halves 50, 52 are divided by the plate 48.

The pinion means 40 includes a generally cylindrical member 54 on a first half 56, and a second half 58. The second half 58 is in mating relationship with the first half 50 of the driving dog 38. The first half 56 includes a pinion gear 60 for mating with the drive means 30. The first 56 and second 58 halves are separated by a radially extending pinion plate 62 integral with the cylindrical member 54. The pinion plate 62 and driving plate 48 are placed against one another to maintain the driving dog 38 and pinion portion 40 in proper interaction. The second half 58 includes three arms 64, 65, 66 spaced apart and extending along the longitudinal axis A from the pinion plate 62 providing an arcuate or discontinuous circular interior surface 68, 69, 70 spaced from the hollow cylindrical portion 42, and a triangular exterior surface 72, 73, 74. Each arm 64, 65, 66 includes first and second ends 76–81 spaced from the legs 44, 45, 46 allowing slight pivotal movement of the driving dog 38 without contact of the arms 64, 65, 66 thereby.

Roller means 84–89 are rotatable within the helm housing 32 and are operatively connected between the pinion arms 64, 65, 66 and the helm housing 32 and the driving legs 44, 45, 46. The roller means 82 includes six cylindrical rollers 84–89. One roller 84–89 is adjacent each end 76–81 of the pinion arms 64, 65, 66 and driving leg 44, 45, 46. The ends 76–81 of the pinion arms 64, 65, 66 provide a sloping surface angled away from helm housing 32 with respect to the adjacent driving leg 44, 45, 46 allowing the roller 84–89 to roll against the ends 76–81 to wedge the rollers 84–89 against the helm housing 32 and to roll away from the ends 76–81 toward the center of the pinion arm 64, 65, 66 to disengage the wedging action and allow the clutch means 28 to be rotated.

Biasing means 96, 97, 98 is connected to each of the pinion arms 64, 65, 66 and extends therefrom against the rollers 84–89. The biasing means 96–98 is generally a leaf spring which is connected at the center of each of the pinion arms 64, 65, 66 and extends outwardly therefrom against the rollers 84–89. The springs 96–98 lock or wedge the roller 84–89 against the pinion arms 64, 65, 66 and the helm housing 32 preventing torsional forces from the driven member 14 to be transmitted to the driving dog 38 and steering wheel 12. The springs 96–98 release the rollers 84–89 upon rotation of the steering wheel 12 and engagement of the legs 44, 45, 46 against the rollers 84–89 allowing the driven member 14 to rotate in response to rotation by the steering wheel 12. The leaf springs 96–98 urge the rollers 84–89 toward the ends 76–81 of the pinion arms 64, 65, 66 thereby wedging the rollers 76–81 between the helm housing 32 and the pinion arms 64, 65, 66. When the steering wheel 12 is rotated and therefore the driving dog 38 rotated, the driving legs 44, 45, 46 dislodge the rollers 84–89 from the locked or wedged position, and then releases the pinion portion 40 to allow the pinion portion 40 to rotate with the driving dog 38 in a transmitting condition.

The drive means 30 includes a second gear 102 lateral to and coacting with the pinion gear 60 for transmitting rotation from the pinion gear 60. The second gear 102 is integrally attached to a smaller gear 104 for driving a larger cable gear 106. The cable gear 106 rotates about a common shaft 108 which extends within the pinion gear 60 and steering shaft 18. The cable gear 106 includes a wheel member 108 having a semi-circular groove 110 therein for receiving the push-pull cable 22. Depending on the direction of rotation, the cable 22 will be "pushed" (extended) or "pulled" (retracted) which motion is transmitted to the steerable member 14.

Figure 3:
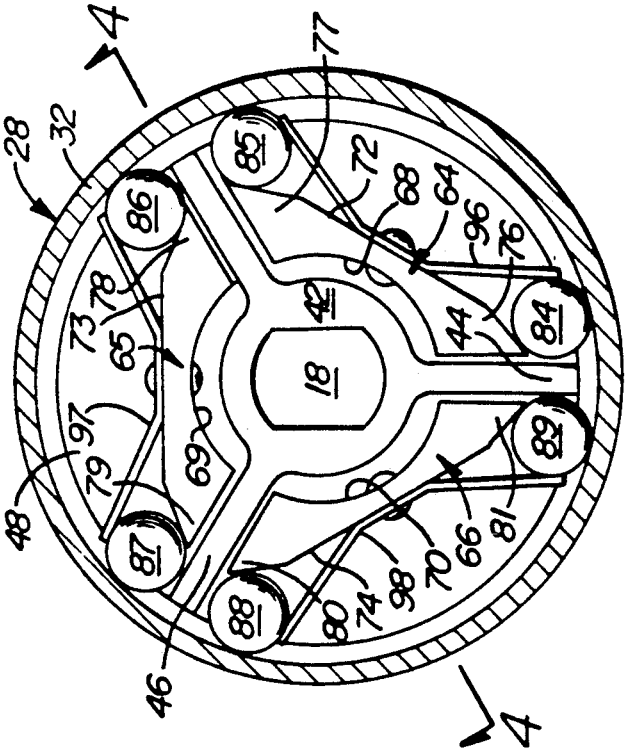
FIG. 3 is a partially cutaway view of the clutch assembly taken along lines 3—3 of FIG. 2.

In operation, as the steering wheel 12 is rotated, the driving dog 38 is rotated. The legs 44, 45, 46 contact the rollers 84–89 disengaging the wedged position thereof and contacting the arms 64, 65, 66 to rotate the pinion cylindrical portion 54 and pinion gear 60. The pinion gear 60 drives the gears 102, 104, 106 which rotates the wheel 108 extending or retracting the push-pull cable 22 dependent upon the direction of rotation. The cable 22 pivots the steerable member 14 in order to steer the boat 16. When the steering wheel 12 is not being rotated and if torsional forces are present on the steerable member 14, such attempted rotation is transmitted by extension or retraction of the cable 22 through the driving means 30 to the clutch means 28. Rotation of the pinion means 40 in the counter clockwise direction (as illustrated in FIG. 3) will force the even reference numbered rollers 84, 86, 88 to wedge between the helm housing 32 and arms 64, 65, 66, and vice versa for clockwise rotation. Only upon rotation of the legs 44, 45, 46 will the rollers 84–89 be dislodge or unwedged to allow rotation.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A steering assembly for interconnecting a steering wheel (12) and a steerable member (14), said assembly comprising:

a push-pull cable (22) having a first end adapted to be connected to the steerable member (14) and having a second end;

helm means (20) adapted to be connected to the steering wheel (12) for controlling said push-pull cable (22) and for transmitting torsional forces from the steering wheel through said push-pull cable to the steerable member in a transmitting condition while preventing torsional forces from the steerable member (14) through the push-pull cable (22) from being transmitted to the steering wheel (22) in a locking control, said helm means (20) including a helm housing (32), clutch means (28) within said helm housing (32) and operatively connected to the steering wheel (12) for preventing feedback of torsional forces from the steerable member (14), and drive means (30) within said helm housing (32) and operatively connected between said clutch means (28) and said push-pull cable (22) for driving said push-pull cable (22) in response to rotation by the steering wheel (12);

said clutch means (28) including a driving dog (38) operatively connected to the steering wheel (12), and a pinion means (40) coacting with said driving dog (38) and operatively connected to said drive means (30), said driving dog (38) comprising a cylindrical member (42) connected to the steering wheel (12) and having a plurality of driving legs (44, 45, 46) radially extending therefrom around said cylindrical member (42);

said pinion means (40) including a pinion gear (60) mating with said drive means (30), a plurality of generally arcuate pinion arms (64, 65, 66) spaced apart and extending between said driving legs (44, 45, 46), each of said pinion arms (64, 65, 66) including two ends (76–81) extending to and spaced from said driving legs (44, 45, 46) for allowing backlash movement of said driving dog (38) without contacting said pinion arms (64, 65, 66);

roller means (84–89) within a rotatable against said helm housing (32) and against said pinion arms (64, 65, 66) in said locking condition and against said driving legs (44, 45, 46) in said transmitting condition;

biasing means (64, 65, 66) connected to said pinion arms (64, 65, 66) and extending against said roller means (84–89) for biasing said roller means (84–89) against said helm housing (32) and said pinion arms (64, 65, 66) to wedge said roller means (84, 89) therebetween in said locking condition and to release said roller means (84–89) by said driving legs (44, 45, 46) in said transmitting condition;

said drive means (30) including gear means (102, 104, 106) coacting with said pinion gear (60) for extending and retracting said push-pull cable (22) in response to rotation of the steering wheel (12).

2. An assembly as set forth in claim 1 further characterized by said pinion means (40) comprising first and second halves (56, 58), said first half (56) comprising a cylindrical member forming said pinion gear (60) and said second half (58) comprising said pinion arms in mating relationship with said driving legs.

3. An assembly as set forth in claim 2 further characterized by said pinion means (40) including a radially extending pinion plate (62) integral with said cylindrical member for separating said first and second halves (56, 58).

4. An assembly as set forth in claim 1 further characterized by said gear means (102, 104, 106) comprising a first gear (102) lateral to and coacting with said pinion gear (60), a second gear (104) of diameter less than said first gear (102) integrally connected to said first gear (102), and a cable gear (106) larger than said second gear (104) for receiving transmitted motion from said second gear (104).

5. An assembly as set forth in claim 4 further characterized by said cable gear (106) comprising a wheel member (108) having a semi-circular groove (110) therein for receiving and controlling movement of said push-pull cable (22).

6. An assembly for preventing feedback from a steerable member (14) to a steering wheel (12), said assembly comprising: housing means (32) having a circular interior surface; driving dog means (38) rotatable within said housing means (32) and adapted to be secured to a steering wheel (12) and including at least two radially extending legs (44, 45, 46) extending to said housing means (32); pinion means (40) rotatable within said housing means (32) and extending between said legs (44, 45, 46) adapted to be secured to a steerable member (14); roller means (84–89) rotatable within said housing means (32) and operatively connected between said pinion means (40) and said housing means (32) and said driving dog means (38); and biasing means connected to said pinion means (40) and extending against said roller means (84–89) for wedging said roller between said pinion means (40) and said housing means (32) in response to torsional forces by the steerable member (14) to prevent resultant rotation of said pinion means (40) and for releasing said roller means (84–89) to unwedge said roller means (84–89) allowing rotation of the steerable member (14) in response to rotation by the steering wheel (12), said pinion means (40) including a pinion gear (60) mating with said drive means (30), a plurality of generally arcuate pinion arms (64, 65, 66) spaced apart and extending between said legs (44, 45, 46), each of said pinion arms (64, 65, 66) including two ends (76–81) extending to and spaced from said legs (44, 45, 46) for allowing backlash movement of said driving dog (38) without contacting said pinion arms (64, 65, 66), said pinion means (40) comprising first and second halves (56, 58), said first half (56) comprising a cylindrical member forming said pinion gear (60) and said second half (58) comprising said pinion arms in mating relationship with said legs.

7. An assembly as set forth in claim 6 further characterized by said driving dog means (38) comprising a cylindrical member (42) connected to the steering wheel (12) having three legs (44, 45, 46) radially extending therefrom spaced equal distance around said cylindrical member (42) adjacent said housing means (32).

8. An assembly as set forth in claim 7 further characterized by said pinion means (40) including three generally arcuate pinion arms (64, 65, 66) spaced apart and extending between said legs (44, 45, 46), each of said pinion arms (64, 65, 66) including two ends (76–81) extending toward and spaced from said legs (44, 45, 46) for allowing slight pivotal movement of said driving dog without contact said pinion arms (64, 65, 66).

9. An assembly as set forth in claim 8 further characterized by said roller means (84–89) comprising six rollers.

10. An assembly as set forth in claim 9 further characterized by including drive means (30) within said housing means (32) and operatively connected with said pinion means (40) for driving the steerable member (12) in response to rotation by the steering wheel (12).

11. An assembly as set forth in claim 10 further characterized by said pinion means (40) including pinion gear (60) mating with said drive means (30).

12. An assembly as set forth in claim 11 further characterized by including a push-pull cable (22) connected between the steerable member (14) and said drive means (30) for driving said push-pull cable (22) in response to rotation by the steering wheel (12).

13. An assembly as set forth in claim 6 further characterized by said pinion means (40) including a radially extending pinion plate (62) integral with said cylindrical member for separating said first and second halves (56, 58).

14. An assembly as set forth in claim 13 further characterized by said driving dog means (38) comprising a hollow cylindrical portion (42) for fixedly receiving a steering wheel shaft (18), said legs (44, 45, 46) integral with and radially extending from said hollow cylindrical portion (42), said hollow cylindrical portion (42) including first and second halves (50, 52), said first half (50) containing said legs (44, 45, 46) and said second half (52) connect to the steering wheel shaft (18), and a drive plate (48) extending from said hollow cylindrical portion (42) and separating said first and second halves (50, 52) for placement against said pinion plate to maintain said legs and arms in interaction.

* * * * *